United States Patent [19]

Gericke et al.

[11] Patent Number: 4,496,083

[45] Date of Patent: Jan. 29, 1985

[54] LOOSE OR BULK GOOD CONTAINER EQUIPPED WITH A DEVICE FOR THE DISCHARGE OF LOOSE OR BULK GOODS

[75] Inventors: Hermann Gericke, Küsnacht, Switzerland; Robert Schavilje, Hilzingen, Fed. Rep. of Germany

[73] Assignee: Gericke AG, Regensdorf, Switzerland

[21] Appl. No.: 378,439

[22] Filed: May 14, 1982

[30] Foreign Application Priority Data

May 22, 1981 [CH] Switzerland ..... 3380/81

[51] Int. Cl.[3] ..... G01F 11/00

[52] U.S. Cl. ..... 222/231; 222/278; 222/236

[58] Field of Search ..... 222/227, 231–233, 222/235, 236, 237, 278, 413, 288; 198/533

[56] References Cited

U.S. PATENT DOCUMENTS

| | | | |
|---|---|---|---|
| 1,537,123 | 5/1925 | Leopold . | |
| 1,673,313 | 6/1928 | Cornelius | 222/227 |
| 1,755,674 | 4/1930 | Tauriainen . | |
| 1,960,778 | 5/1934 | Goss et al. . | |
| 2,753,089 | 7/1956 | Phillips | 222/227 |
| 2,794,577 | 6/1957 | Van Leeuwen | 222/227 |
| 2,796,202 | 6/1957 | Lawrence et al. . | |
| 3,895,744 | 7/1975 | Powning . | |
| 4,207,995 | 6/1980 | Neely . | |

FOREIGN PATENT DOCUMENTS

| | | |
|---|---|---|
| 1277144 | 9/1964 | Fed. Rep. of Germany . |
| 1481186 | 11/1966 | Fed. Rep. of Germany . |
| 2910923 | 3/1979 | Fed. Rep. of Germany . |
| 2025557 | 12/1969 | France . |
| 506986 | 2/1970 | Switzerland . |
| 529684 | 10/1971 | Switzerland . |

*Primary Examiner*—H. Grant Skaggs
*Attorney, Agent, or Firm*—Werner W. Kleeman

[57] ABSTRACT

Within a loose or bulk good container there is arranged a loosening wheel which is wider than a discharge spiral. The loosening wheel is secured by a wheel holder device at a removable wall portion of the container. The removable wall portion is arranged transversely with respect to the discharge spiral and is fixedly connected with an outlet or discharge connection of the container. During exchange of the discharge spiral and/or the loosening wheel there can be removed as a structural unit or assembly from the container wall the removable wall portion together with the outlet or discharge connection, the wheel holder device and the loosening wheel, and such structural unit can be replaced by a different structural unit containing the corresponding elements but of different dimensions.

19 Claims, 5 Drawing Figures

LOOSE OR BULK GOOD CONTAINER EQUIPPED WITH A DEVICE FOR THE DISCHARGE OF LOOSE OR BULK GOODS

BACKGROUND OF THE INVENTION

The present invention relates to a new and improved construction of a container or container arrangement for loose or bulk goods and which is equipped with a device for the discharge or outfeed of the loose or bulk goods out of a lower outlet connection or the like.

The container arrangement of the present development comprises as the discharge device a discharge or outfeed element, for instance a discharge spiral rotatably arranged at the lower portion or region of the container. This discharge spiral extends by means of its outer end into a discharge or outlet connection and its inner end portion is rotatably mounted. A rotatable drive is provided for the discharge spiral. There is also provided a wheel holder device containing at least one loosening or opening wheel which is rotatably mounted above the discharge spiral within the container. The loosening or opening wheel serves for the opening or loosening of the portion of the loose or bulk material which is momentarily ready to be discharged or outfed. The axis of rotation of the loosening wheel forms at least approximately a right angle with the axis of rotation of the discharge spiral.

Such type of bulk good containers for bulk or loose goods or materials, such as powders, granulates, fibers and flocks, are well known in the art and, typically, possess at a lower portion or region thereof having a substantially U-shaped or V-shaped configuration a discharge or outfeed spiral, also commonly referred to in this art as a feed or conveyor screw or feed or conveyor worm. As a general rule, the discharge spirals are provided with a variable drive for adjusting the discharge capacity or output throughout a certain range. Such discharge spirals have an appearance similar to that of an at least approximately rigid helical spring, but also could be designed as a full blade worm with or without an axial shaft. These known bulk good containers are afflicted with the drawback that in the case of materials which flow with great difficulty there are formed material bridges or clumps over the discharge spiral, such material bridges precluding a continuous dosing of the loose or bulk goods. Directly above the discharge spiral the loose or bulk goods are compacted most intensively, so that their flow or transport behavior is poorest at that location. The hollow space below each material bridge does not allow any of the loose or bulk materials to flow therethrough, and thus tends to act similar to a foreign body. Even material bridges which have been desintegrated tend to usually reform.

In such type of bulk good containers there have already been installed loosening or opening devices in order to avoid these drawbacks. These loosening or opening devices are arranged concentrically about the axis of the discharge spiral. Other constructions of loosening or opening devices have the axis thereof located above the axis of rotation of the discharge spiral, usually parallel to the rotational axis of the discharge spiral. In such cases there can occur a power transmission from the spiral drive to the shaft of the loosening device. However, if the axis of the loosening device is disposed at right angles to the axis of the discharge spiral, then the loosening device must be provided with its own motor drive.

In the case of motor drives limitations are placed upon the change in their power output range. For high power outputs, as general rule, it is only possible to operate the drive motor at 200 revolutions per minute, since otherwise the loose or bulk goods no longer will travel into the outlet or discharge spiral and be reliably entrained. In the case of direct-current regulator drives there is thus possible a variation of maximum 1:20 to 1:30. For lower power outputs the range is limited to a rotational speed of at least 6 to 8 revolutions per minute, since otherwise there occurs a thrust-like ejection of the loose or bulk goods. Therefore, in order to obtain greater discharge outputs there have been proposed bulk good containers wherein the discharge or outlet connection is attached to a releaseable front plate and also the discharge spiral is releaseable and exchangeable. Consequently, one and the same bulk good container can be operated with different diameters of the discharge spirals, for instance in a range of 20 mm to 80 mm. Each discharge spiral is again operated at the rotational speed range governed by the rotary drive. However, there are desired much higher output capacities because during the dosing of loose or bulk materials, depending upon their properties, depending upon the humidity of the air, the product moisture content, the grain size distribution or the like, the effective discharge outputs can be quite different even for a given rotational speed range and for a given construction of the bulk good container. An output range which has been determined in the laboratory, during production however experiences unexpected large deviations. It is then necessary to shift to a much larger or much smaller dosing range for a given bulk good container for a predetermined field of application, al speed regulation, rather only can be carried out with the described exchange of the discharge spirals.

All of the previously described bulk good containers are afflicted with the drawback that there is either provided an additional drive or an expensive power transmission system containing additional shaft throughpassage means, seals and so forth for the loosening device. There is known from, for instance, U.S. Pat. No. 1,960,778 a loose or bulk good container which does not require an additional power transmission or drive for the loosening device. Instead, the loosening device is installed within the bulk or loose material container with the axis perpendicular to the axis of the discharge spiral and the arrangement is constructed such that the discharge spiral drives the loosening device in accordance with the principle of a worm-bevel gear arrangement. Stated in another way, the loosening device itself is constructed such that it engages, like a gear, directly with the discharge spiral. However, this construction is limited to a certain diameter of the discharge spiral. Furthermore, the loosening device only can be dismantled by carrying out relatively complicated disassembly work, and there is not afforded the requisite accessibility for accomplishing a complete or thorough cleaning operation when the equipment is changed over so as to process a different product. Furthermore, it is not possible to exchange the discharge spiral for the purpose of obtaining greater output ranges with a discharge spiral having a larger or smaller external diameter because, then, the axial spacing of the discharge spiral and the loosening device as well as the module and so forth no longer would appropriately match one another and because the outlet or discharge connection is fixedly secured at the housing.

With a prior art bulk or loose good container similar to the last-mentioned state-of-the-art construction, and as disclosed for instance in U.S. Pat. No. 3,895,744, there is additionally required a stirrer or agitator device for avoiding the formation of material bridges. The agitator device must be driven by the loosening wheel. Apart from the previously mentioned drawbacks, with this prior art construction there is additionally present the equipment expenditure needed for the provision of the agitator device. The inclusion of such agitator device in such system design additionally renders more difficult, if not preventing, the dismantling and, thus, exchange of the discharge spiral.

An accommodation of the form and the arrangement of the loosening device with the presently known bulk good containers is therefore possible, if at all, only with an appreciable expenditure in time, labor and materials.

SUMMARY OF THE INVENTION

Therefore, with the foregoing in mind it is a primary object of the present invention to provide a new and improved construction of a bulk good container which is not afflicted with the aforementioned drawbacks and limitations of the prior art constructions.

Another and more specific object of the present invention aims at the provision of a new and improved construction of a loose or bulk good container of the previously mentioned type, which avoids the disadvantages of the prior art designs, and, in particular, in a most simple manner increases the output capacity and the field of application of the bulk good container, without however intolerably enlarging its dimensions or impairing the uniformity of the discharged or ejected flow of material which is being processed.

Yet a further significant object of the present invention is directed to a new and improved construction of a bulk good container which is relatively simple in design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the bulk good container of the previously mentioned type is manifested by the features that, the loosening wheel is constructed so as to be wider than the discharge spiral and is attached along with the wheel holder device at a removable wall portion of the container. This removable wall portion of the container is arranged transversely with respect to the direction of extent of the discharge spiral, and the discharge or outlet connection is fixedly connected with the removable wall portion.

By virtue of the coacting combination of elements and the features provided for the inventive bulk good container there is surprisingly realized a good accessibility thereof, especially as concerns the interior of the container. The loosening or opening wheel can be simply and rapidly installed and again dismantled in an advantageous manner whenever an exchange thereof is necessary, for instance due to exchange of the discharge spiral. There can be simultaneously removed along with the removable wall portion also the discharge connection and such can be exchanged with a different discharge connection if, for instance, there should be used a discharge spiral having a larger or smaller diameter in relation to the size of the prior used discharge spiral. Since there can be removed simultaneously along with the removable wall portion also the wheel support device and the discharge connection, the interior of the bulk good container is readily accessible in a most simple manner and, for instance, can be cleaned without having to undertake any additional assembly measures if, for instance, there occurs an exchange of the processed bulk or loose materials. In this way it is possible to reduce to a minimum the downtime of the inventive bulk good container. A further advantage resides in the fact that there can be accomplished an optimum accommodation of the loosening wheel to the operating conditions of the bulk good container, for instance to the momentarily processed bulk or loose materials, the throughput thereof, the employed discharge spiral or the like, so that the output range and the range of the field of application of the bulk good container of predetermined dimensions can be much greater than was heretofore realizeable by merely changing the rotational speed.

Due to the larger width of the loosening or opening wheel in relation to the discharge spiral, for instance in relation to its cross-section or diameter, it is possible for the loosening or breaking-up of the bulk or loose materials to be carried out over the entire width of the discharge spiral. At the same time it is also possible to act upon a lateral formation of material bridges at the region of the discharge spiral by means of the loosening or opening wheel and such can be disintegrated, if not in fact totally avoided. Advantageously, the loosening wheel is constructed in such a manner that it engages, for instance, like a gear directly with the discharge spiral, i.e. it can be provided with the same teeth, so that it can be driven by the discharge spiral. For this purpose the lower portion of the path of movement of the loosening or opening wheel preferably intersects the path of movement of the discharge or outfeed spiral.

In advantageous manner the removable wall portion of the container is desirably constructed as a portion of a container wall and, for instance, designed in the form of an assembly plate which, for example, simultaneously closes from the outside an access opening in the container wall. In this way the interior of the bulk good container is readily accessible and the wheel holder device along with the loosening wheel and the removable wall portion can form an exchangeable structural unit or assembly, and the discharge or outlet connection can be non-releaseably connected with the wall portion. If the loosening or opening wheel is arranged so as to be, for instance, elevationally adjustable in its position, then the same can be adjusted to the momentarily employed diameter of the discharge or outfeed spiral. In this way the same loosening or opening wheel can be used for discharge spirals having different diameters.

Additionally, there can be provided means in order to impart to the loosening or opening wheel during its rotational movement, for instance, at least one additional movement component. This additional movement component can be a wobble movement component, so that the loosening wheel can be constructed or arranged, for instance, in the manner of a wobble wheel. Preferably, the removable wall portion consists of a bending-resistent material and the discharge or outlet connection is advantageously connected, for instance, non-releaseably with the removable wall portion.

Due to the construction of the bulk good container according to the invention, especially by virtue of the removable wall portion containing the parts or elements located thereat as contemplated by the invention, there can be ensured for the greatest possible security that, even untrained equipment operators or individuals, will properly accomplish a simultaneous exchange of the loosening or opening wheel and the discharge spiral.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
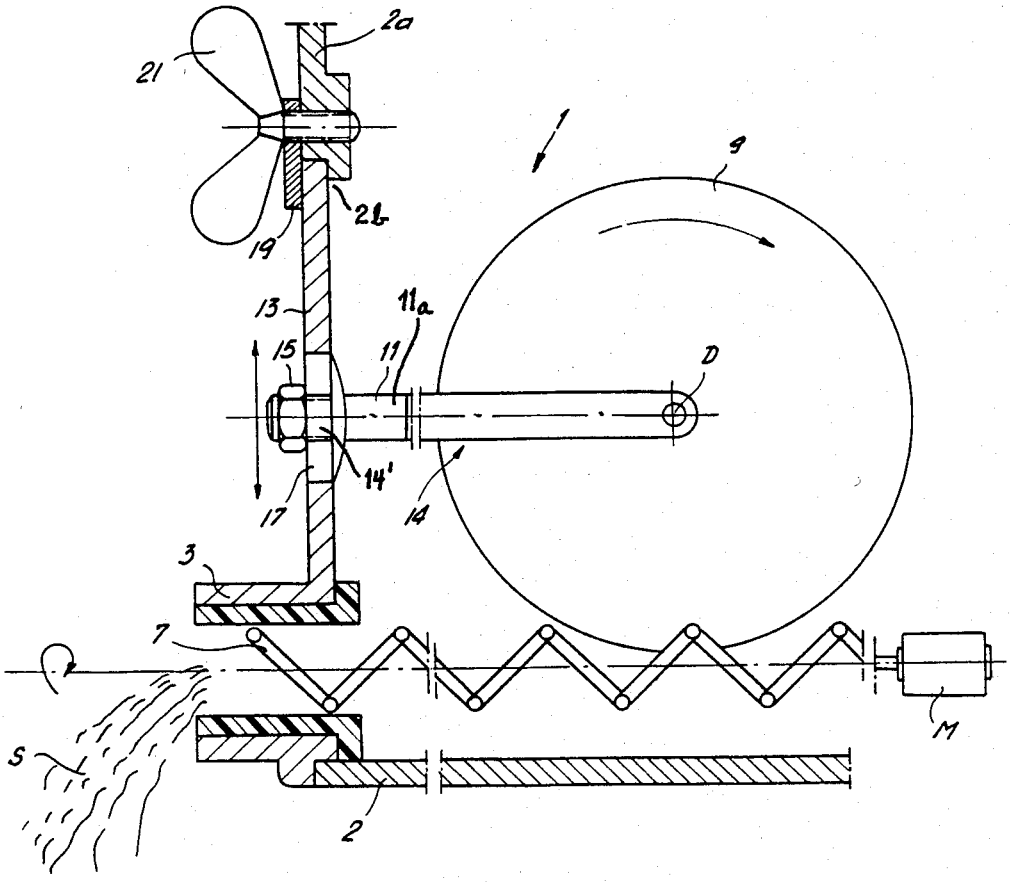
FIG. 1 schematically illustrates in longitudinal sectional view a portion of a container for processing bulk or loose goods according to the invention.

Describing now the drawings, it is to be understood that only enough of the construction of the loose or bulk good container arrangement has been illustrated in the drawings as will enable those skilled in this art to readily understand the underlying principles and concepts of the present development, while simplifying the illustration of the drawings. Turning attention now specifically to FIG. 1, there is depicted therein a lower portion of a bulk good container 1 equipped with a container floor or base portion 2, a front container wall 2*a* and a lower discharge or outlet connection 3 from which there can be discharged a stock stream S of any suitable loose or bulk material which is being processed, for instance in the form of a grain-like or pulverulent material, a granular or also a fiber-like or flock-like material. The discharged material, after it effluxes out of the discharge or outlet connection 3, can freely move further or can be positively guided, as desired. The discharge device of the bulk good container 1 comprises a rotatable discharge element 7, referred to herein generically as a discharge or outfeed spiral, which is sealingly arranged substantially horizontally over the container floor or base portion 2. This discharge or outfeed spiral 7 extends at its outwardly directed or outer free end, shown at the left-hand side of the arrangement of FIG. 1, freely into the discharge or outlet connection 3 or equivalent structure, which preferably is lined with a suitable plastic lining (not shown), such as for instance formed of "TEFLON" and surrounds with play a short outer end or terminal portion of the discharge spiral 7, as shown. This discharge or outfeed spiral 7 is only arranged in a cantilever fashion at its inwardly directed end, i.e. at its right-hand end shown in FIG. 1, and is drivingly connected with a suitable rotational drive or drive means M which, for instance, can be constituted by an infinitely variable drive or transmission motor. Above the discharge or outfeed spiral 7 there is rotatably arranged a suitable loosening or opening device 9, here shown in the form of a loosening or opening wheel which has only been conveniently depicted in FIG. 1 in its outer contour. The rotational axis D of the loosening or opening wheel 9 extends essentially perpendicular to the plane of the drawing of FIG. 1, and the wheel 9 defines a plane containing the rotational axis D and extending perpendicularly to the lengthwise axis of the discharge or outfeed spiral 7, and therefore, forms essentially a right angle with the axis of rotation of the discharge or outfeed spiral 7, this axis of rotation of the discharge spiral 7 having been schematically shown in broken lines in the illustration of FIG. 1.

Figure 5:
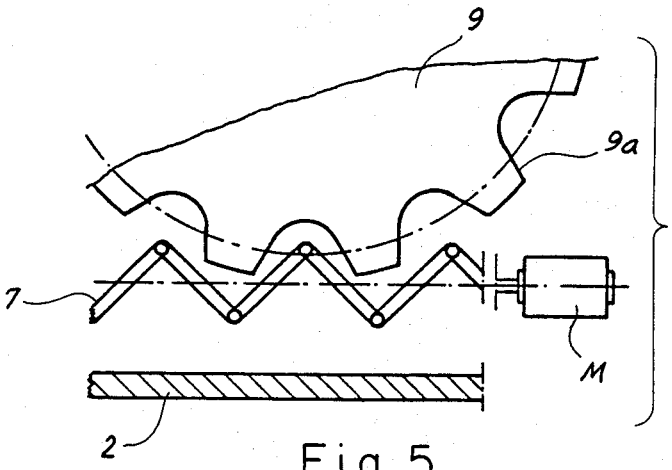
FIG. 5 is a view similar to FIG. 1 of a container as shown in FIG. 1 including a modified loosening wheel.

The loosening or opening wheel 9 arranged within the container 1 and above the discharge spiral 7 possesses at its outer circumference or periphery engaging elements 9*a*(see FIG. 5), by means of which it can engage into the discharge or outfeed spiral 7. Upon rotation of the discharge spiral 7 the loosening or opening wheel 9 therefore can be placed into an appropriate rotational movement, as the same has been schematically indicated by the not particularly referenced arrow shown in FIG. 1 within the depicted confines of the loosening wheel 9. However, there also can be provided a separate drive for the loosening or opening wheel 9. This loosening or opening wheel 9 furthermore possesses a width which is greater than the width or the diameter of the discharge spiral 7. Moreover, such loosening wheel 9 or equivalent structure thus extends by means of its width at least over the total width of the discharge spiral 7, and therefore also can engage with loose or bulk material located laterally above such discharge spiral 7, and thus can loosen or disintegrate bulk material which has dammed-up at such location. The engaging elements 9*a* (see FIG. 5) also function as loosening elements. Preferably, the loosening wheel 9 is equipped at its outer circumference or periphery with vane-like or bucket-like configured loosening or desintegration elements 9*a* which are illustrated in FIG. 5 and which extend laterally at least over the width or the outer diameter of the discharge spiral 7 and preferably protrude therepast. The loosening or opening wheel 9 can then engage, for instance, by means of not particularly illustrated pins protruding radially from a hub disk, into the worm construction of the discharge spiral 7 and thus can be driven by the latter.

By virtue of the previously described arrangement of the loosening or opening wheel 9 the path of movement of such loosening wheel 9 thus intersects to a certain degree the path of movement of the discharge or outfeed spiral 7, by means of which there is limited the module of the latter. By means of this module and the diameter ratio of both paths of movement there are determined, for instance, also the optimum number and construction of the not particularly illustrated vane-like or bucket-like loosening elements of the loosening or opening wheel 9.

Figure 2:
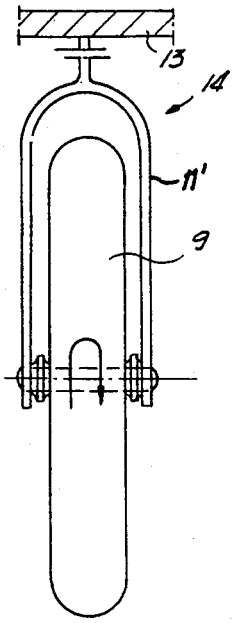
FIG. 2 schematically illustrates details of the loosening wheel-holder device of the arrangement of loose or bulk good container shown in FIG. 1.

As best seen by referring to FIG. 2, the loosening or opening wheel 9 is positionally retained in place by means of a wheel holder device 14 which comprises a tuning fork-like or bifurcated holder member 11 between whose fork legs or tines 11' there is rotatably mounted the loosening or opening wheel 9. However, it is readily possible to design the holder member 11 also in a number of other different ways. What is important is that the wheel holder device 14 along with the holder member or holder 11 is secured at a bending-resistent wall portion in the form of a mounting plate 13 which simultaneously detachably closes from the outside an access opening 2*b* provided at the container wall 2*a*

(FIG. 1). The holder member 11 contains a pin or plug-like portion 11*a* which protrudes away from the mounting plate 13 into the interior of the container 1. In the container wall 2*a* there is also arranged the discharge or outlet connection 3 which is preferably non-releaseably connected therewith, and which connection, for instance, can be accomplished by pressing the discharge connection 3 into an appropriately formed opening provided at the container wall 2*a* or by welding the same thereat. This arrangement results in the constructional as well as also operational noteworthy advantages that the mounting or assembly plate 13 can be connected with the discharge or outlet connection 3. Each time that there is removed the mounting plate 13 there is thus afforded access to the loosening or opening wheel 9 and also to the discharge or outfeed spiral 7, so that both of these components 9 and 7 are always simultaneously readily accessible for maintenance and/or fitting or accommodation purposes. The downtime or dead-time of the bulk good container 1 and the subsequently or downstream arranged machines therefore is reduced to an absolute minimum, if following the aforementioned removal of the mounting plate 13 there is again immediately established the operational readiness of the equipment by assembling the components 14 and 9 and possibly the component 7 having different dimensions.

The base of the holder member 11 possesses an externally threaded portion 14' and is attached by means of an attachment nut member 15 or equivalent structure in a vertical longitudinal slot 17 of the mounting or assembly plate 13. Consequently, the loosening or opening wheel 9 is adjustable in elevation from the outside, as generally indicated by the double-headed arrown shown at the left-hand side of FIG. 1, i.e. the mounting plate 13 need not be solely dismantled for this purpose. The mounting plate 13 itself is merely here secured by means of a suitable drop lock device 19 or equivalent structure and a safety wing screw 21 or the like at the container wall 2*a*. However, the mounting plate 13 also can be attached in a number of different appropriate ways and at more than one location, for instance especially also at the floor 2 of the container 1. By virtue of the elevational adjustability of the loosening or opening wheel 9 the latter can be accommodated in a most simple and suitable fashion to the momentarily encountered diameter of the discharge or outfeed spiral 7. It is therefore also possible in this manner to accommodate the loosening wheel 9 to the momentarily encountered diameter of the discharge spiral 7 by adjusting such loosening wheel elevationally in its position.

By virtue of the interconnected components, i.e. the loosening wheel 9 with the holder member 14, the mounting plate 13 and the thereat located discharge connection 3, there is provided a structural unit or assembly which can be dismantled in its entirety as a unit upon changing, for instance, the type of loose or bulk materials which are being processed or other operating conditions and such structural unit can be replaced by a different structural unit whose components or elements possess different dimensions. By virtue of the discharge connection 3 which is non-releaseably connected with the mounting or assembly plate 13 and the therewith operatively correlated loosening or opening wheel 9 it is possible, for instance, not to be able to install such structural unit or assembly by means of the mounting plate 13 when the discharge or outfeed spiral 7 possesses too large a diameter. On the other hand, if there is present a discharge spiral 7 having too small a diameter, this will be immediately perceivable upon viewing the interior of the equipment through the discharge connection 3, or, on the other hand, during the initial trial run of the equipment. In other words, by virtue of the indirect connection of the discharge or outlet connection 3 with the related loosening or opening wheel 9, i.e. the mutually interconnected parts of the bulk good container which can be installed and dismantled and are present in the combination as aforedescribed, there is realized an appreciable security, so that the maintenance and/or accommodation to different operating conditions can be even entrusted to unskilled individuals or operators. Different colors or other appropriate markers can additionally facilitate the momentarily correct selection of the required parts or components from the replacement part stock located for instance in a storage room.

Figure 3:
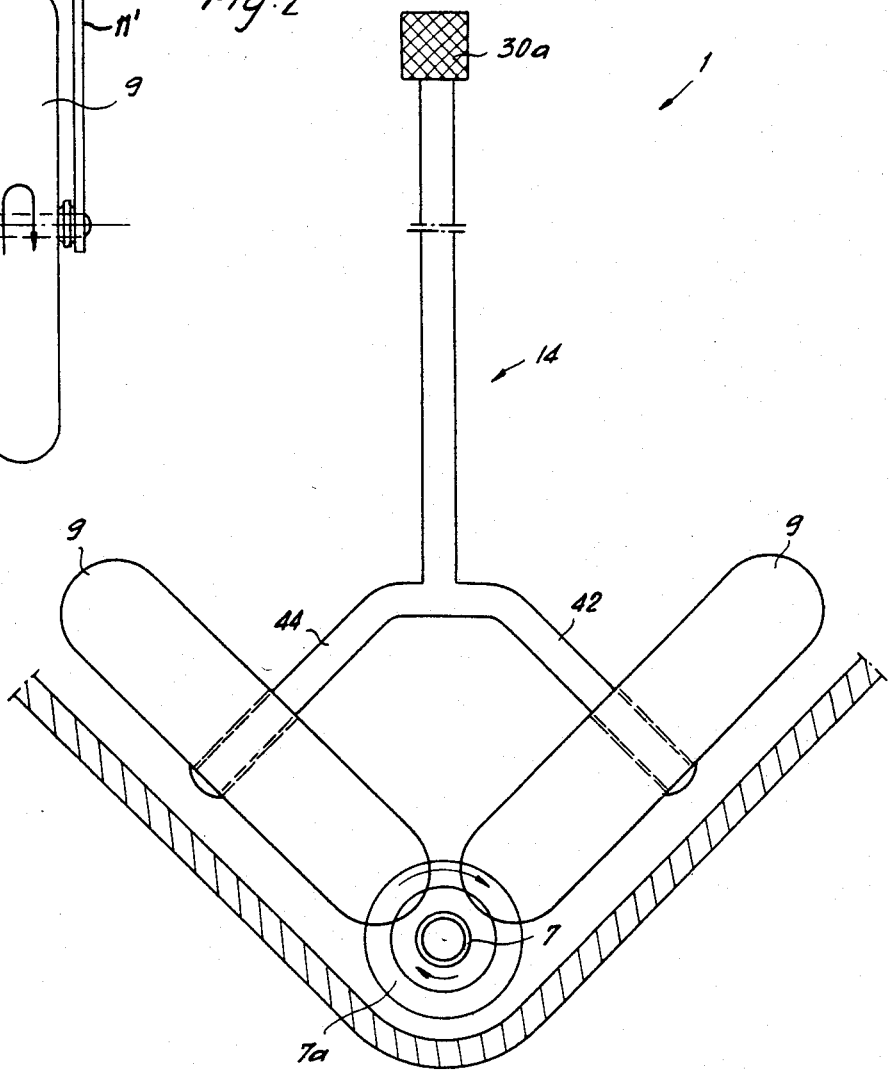
FIG. 3 schematically illustrates in cross-sectional view a different construction of bulk good container according to the invention.
Figure 4:
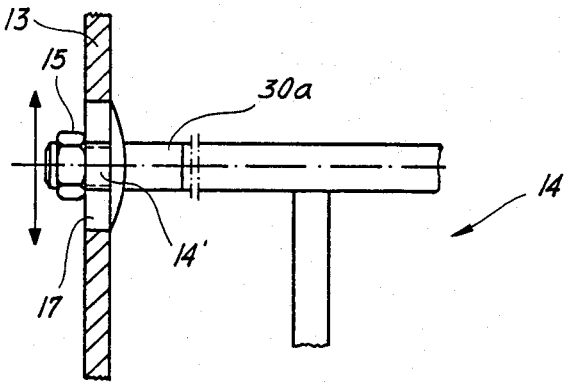
FIG. 4 is a partially sectional view of a detail of the container as shown in FIG. 3.

With the modified construction of loose or bulk good container depicted in FIG. 3, the wheel holder device 14 extends from above into the inner space of the bulk good container 1 and is constructed in the form of a double-tine or double-prong fork member. The tines or prongs 42 and 44 are spread so far apart from one another that they are directed essentially at right angles towards the related side wall of the substantially V-shaped lower container portion, but do not contact such lower portion of the container, as shown in FIG. 3. At both of the lower end portions of the tines or prong members 42 and 44 there is rotatably mounted the related loosening or opening wheel 9 which is held by not particularly illustrated but conventional fixation or retaining elements upon the related tine or prong member 42 and 44. The wheel holder device 14 is mounted at a beam 30*a* which extends essentially parallel to the lengthwise axis of the discharge or outfeed spiral 7. One end of the longitudinal beam 30*a* is connected with a removable wall portion of the bulk good container 1, which in the embodiment as illustrated in FIG. 4 is constructed and arranged just as in the embodiment heretofore described with regard to FIG. 1. Preferably, the longitudinal beam 30*a* consists of a bending-resistent material. If desired, there also can be arranged a not particularly illustrated vibration device at the longitudinal beam 30*a*, by means of which it is possible to additionally act upon or influence the bulk or loose material by means of the loosening element or wheel 9.

Each loosening or opening wheel 9 is again constructed to be wider than the discharge or outfeed spiral 7 i.e. its cross-section or diameter, and is equipped at its outer circumference with appropriate engaging and loosening elements 9*a*, by means of which it can engage into the discharge spiral 7, as such was likewise previously described already in conjunction with the embodiment of FIG. 1 and FIG. 5.

Both of the loosening wheels 9 are conjointly and synchronously driven in the same directional sense, however not by the discharge or outfeed spiral 7, rather by a loosening spiral 7*a* which preferably concentricaly surrounds the discharge spiral 7. This loosening spiral 7*a* requires a somewhat greater expenditure in equipment, as has already been previously explained, but however is independent of the discharge spiral 7 as concerns direction of rotation according to both of the curved arrows, the rotational velocity, the length and module. The loosening spiral 7*a* can in fact be reversed in its rotation, something which is not possible for the discharge spiral 7. In practical applications, with this system design there is afforded such an enhanced additional freedom of adaptability and expanded use of the equipment that the system can be accommodated to different output ranges and/or different bulk materials. Additionally, it is possible to change the diameter of both loosening wheels 9, which can be accomplished in this case in a few seconds, i.e. practically without any noticeable interruption in the operation of the equipment, by exchanging the entire wheel holder device 14 including both loosening or opening wheels 9 and the longitudinal beam 30*a* together with the removable wall portion.

The wheel holder device 14 of the exemplary embodiment of bulk good container as depicted in FIG. 3 can be accommodated in a particularly good and advantageous fashion to the form of the lower container portion, because each loosening or opening wheel 9 is exactly located at the location which is particularly susceptible to the formation of material bridges or the like. It is also particularly easily accessible and securely arranged, so that the bulk good container of the arrangement of FIG. 3 also can be serviced by unskilled operators or the like. The upper opening of the bulk good container can be protected, for instance, by a cover or a wire mesh or equivalent protection device. By means of the wheel holder device 14 which extends from above into the interior of the bulk good container 1 there can be accomplished a particularly favorable elevational adjustment.

To the extent that there is provided or required in any case a loosening spiral *7a*, then it is possible for such to assume, with any design of the wheel holder device inclusive of the loosening wheel 9, the role of the drive element. With sufficiently short loosening or opening spirals *7a* there is also available the possibility of driving one of the loosening wheels 9 by the loosening spiral *7a* and the other loosening wheel 9 by the discharge or outfeed spiral 7, so that the designer is afforded still further fields of applications and an enlargement or enhancement in the system construction. Opening or loosening spirals *7a* which rotate in the same sense as the discharge or outfeed spiral 7 produce, under the same conditions, a different loosening or opening action than an arrangement where the spirals 7 and *7a* rotate in opposite sense, as the same has been indicated in FIG. 3 by both of the oppositely directed arrows. The difference can be extremely pronounced in the case of bulk or loose materials of different properties and even with prior constructions already require an especially careful accommodation. The same holds true when altering the direction of rotation for the loosening action of the loosening wheel 9. Quite generally it holds true that, for the optimum design of the container for each bulk material property, discharge output, construction and operational mode, there can be empirically measured the brief fluctuations of the discharged stream of the bulk or loose materials and such preferably recorded at a recording strip or the like, in order to be able to compare the plotted curves with one another. In so doing the measuring magnitude is either the weight, the volume or the pulse of the momentarily discharged bulk material stream.

The heretofore discussed exemplary embodiments can be modified in a number of different ways. Thus, for instance, the form of the bulk good container, the number, design, arrangement and mode of attachment of the loosening wheels 9 and the bending-resistent wall portion 13 can be altered in a number of suitable ways. The tines or prongs of the holder member or device 11 can be elongated or extended in a manner such that there operate therebetween two or more loosening wheels 9 in the lengthwise direction of the discharge spiral 7, in the manner indicated by the one loosening wheel 9 of the arrangement of FIG. 1. Viewed in cross-section the bulk good container can possess a U-shaped or V-shaped profile configuration.

While there are shown and described present preferred embodiments of the invention, it is to be distinctly understood that the invention is not limited thereto, but may be otherwise variously embodied and practiced within the scope of the following claims.

What we claim is:

1. A bulk good container arrangement comprising:

a container having a lower container portion;

a lower discharge connection provided at the lower container portion;

a rotatable discharge spiral arranged at the lower container portion;

said discharge spiral having an outer end extending into the lower discharge connection;

said discharge spiral having an inner end portion which is rotatably mounted;

rotatable drive means for driving said discharge spiral;

at least one loosening wheel for the bulk goods and arranged within the container;

a loosening wheel-holder device for rotatably mounting said at least one loosening wheel within the container above the discharge spiral;

said loosening wheel serving for loosening the portion of the bulk goods which are ready to be discharged out of the container;

said loosening wheel having an axis of rotation and defining a plane containing said axis of rotation;

said discharge spiral having an axis of rotation;

said plane containing the axis of rotation of the loosening wheel forming with the axis of rotation of the discharge spiral at least approximately a right angle;

said loosening wheel being structured to be wider than the discharge spiral;

said container having a removable wall portion;

said loosening wheel and said loosening wheel-holder device being secured to said removable wall portion of said container; and said removable wall portion of said container being arranged transversely with respect to said discharge spiral and being fixedly connected with said lower discharge connection.

2. The bulk good container arrangement as defined in claim 1, wherein:

said removable wall portion forms part of a container wall.

3. The bulk good container arrangement as defined in claim 2, wherein:

said removable wall portion comprises a mounting plate which closes from the outside an access opening provided at the container wall.

4. The bulk good container arrangement as defined in claim 1 or 3, wherein:

said loosening wheel-holder device comprises a substantially fork-shaped holder member arranged within the container; and said fork-shaped holder member having fork tines between which there is rotatably arranged said at least one loosening wheel.

5. The bulk good container arrangement as defined in claim 4, wherein:

said fork-shaped holder member possesses a substantially tuning-fork configuration.

6. The bulk good container arrangement as defined in claim 1, further including:

beam means for securing the loosening wheel-holder device to said removal wall portion; and said beam means having one end portion which is connected with the removable wall portion.

7. The bulk good container arrangement as defined in claim 1 or 6, wherein:

said loosening wheel-holder device comprises a substantially fork-like holder member having fork tines and arranged internally of said container;

a further loosening wheel; and each of said loosening wheels being rotatably arranged at the respective end of a related one of the fork tines.

8. The bulk good container arrangement as defined in claim 1, further including:

means for elevationally positioning said loosening wheel.

9. The bulk good container arrangement as defined in claim 1, wherein:

said loosening wheel-holder device together with said loosening wheel and said removable wall portion form an exchangeable structural unit; and said removable wall portion being non-releaseably connected with said discharge connection.

10. The bulk good container arrangement as defined in claim 1, wherein:

said loosening wheel-holder device contains a plug-like member which protrudes from the mounting plate into the internal space of the container.

11. The bulk good container arrangement as defined in claim 10, wherein:

said plug-like member extends outwardly through an opening provided in the mounting plate.

12. The bulk good container arrangement as defined in claim 1, wherein:

the loosening wheel has a path of movement;

said discharge spiral has a path of movement; and a lower portion of the path of movement of the loosening wheel intersecting with the path of movement of the discharge spiral.

13. The bulk good container arrangement as defined in claim 1, further including:

means for imparting to the loosening wheel, during the rotational movement thereof, at least an additional movement component.

14. The bulk good container arrangement as defined in claim 13, wherein:

said imparting means imparts a wobble movement component to the loosening wheel.

15. The bulk good container arrangement as defined in claim 1, wherein:

said removable wall portion is formed of bending-resistent material.

16. The bulk good container arrangement as defined in claim 1, wherein:

said at least one loosening wheel possesses at its outer circumference engaging elements which engage into said discharge spiral.

17. The bulk good container arrangement as defined in claim 16, wherein:

said at least one loosening wheel is equipped at its outer circumference with loosening elements for the bulk goods; and said loosening element being constituted by said engaging elements.

18. The bulk good container arrangement as defined in claim 17, wherein:

said loosening elements are selected from the group consisting of vane-like loosing elements, and bucket-like loosening elements.

19. The bulk good container arrangement as defined in claim 1, wherein:

said at least one loosening wheel possesses an outer circumference engaging into said discharge spiral, said outer circumference of said at least one loosening wheel being provided with engaging elements for said engaging into said discharge spiral, and further comprising loosening elements, said loosening elements being selected from the group consisting of vane-like loosening elements, and bucket-like loosening elements.

* * * * *

UNITED STATES PATENT AND TRADEMARK OFFICE

CERTIFICATE OF CORRECTION

PATENT NO. : 4,496,083

DATED : January 29, 1985

INVENTOR(S) : Hermann Gericke et al

It is certified that error appears in the above—identified patent and that said Letters Patent is hereby corrected as shown below:

Column 2, line 37, please delete "al" and insert --something which is no longer possible purely by means of the rotational--

Signed and Sealed this

*Twenty-third* Day of *July 1985*

[SEAL]

*Attest:*

DONALD J. QUIGG

*Attesting Officer* *Acting Commissioner of Patents and Trademarks*